US007886646B2

(12) United States Patent
Bannasch et al.

(10) Patent No.: US 7,886,646 B2
(45) Date of Patent: Feb. 15, 2011

(54) METHOD AND APPARATUS FOR PROTECTING SHIPS AGAINST TERMINAL PHASE-GUIDED MISSILES

(75) Inventors: Heinz Bannasch, Schönau (DE); Martin Fegg, Schönau (DE)

(73) Assignee: Rheinmetall Waffe Munition GmbH, Ratingen (DE)

( * ) Notice: Subject to any disclaimer, the term of this patent is extended or adjusted under 35 U.S.C. 154(b) by 571 days.

(21) Appl. No.: 10/574,532

(22) PCT Filed: Sep. 1, 2004

(86) PCT No.: PCT/EP2004/009736

§ 371 (c)(1),
(2), (4) Date: Dec. 1, 2006

(87) PCT Pub. No.: WO2005/033616

PCT Pub. Date: Apr. 4, 2005

(65) Prior Publication Data

US 2007/0159379 A1 Jul. 12, 2007

(30) Foreign Application Priority Data

Oct. 2, 2003 (DE) ..... 103 46 001

(51) Int. Cl.
*B64D 1/04* (2006.01)

(52) U.S. Cl. ..... 89/1.11; 89/41.13; 89/41.14

(58) Field of Classification Search ..... 89/1.11, 89/41.13, 41.14, 205
See application file for complete search history.

(56) References Cited

U.S. PATENT DOCUMENTS 4,222,306 A * 9/1980 Maury ..... 89/1.41

(Continued)

FOREIGN PATENT DOCUMENTS

DE 28 47 233 A1 5/1980

(Continued)

OTHER PUBLICATIONS

H.K. Herrmann: "Tarnen and Tauschen beider Marine" Wehrtechnik, Bd. 21, Nr. 3, Mar. 1989 , Seiten 48-54, XP002309726 Bonn, DE.

(Continued)

*Primary Examiner*—Stephen M Johnson
*Assistant Examiner*—Daniel J Troy
(74) *Attorney, Agent, or Firm*—Buchanan Ingersoll & Rooney PC

(57) ABSTRACT

The present invention concerns a method for protecting ships against terminal phase-guided missiles provided with a target data analysis system, as well as an apparatus for implementing the method, wherein the missile moving in a direction towards the ship to be protected is detected by suitable sensors, located, and its expected trajectory is calculated by a computer; the type of target data analysis performed by the missile and its attack structure is detected by suitable sensors, and the missile is classified with regard to the type of its target data analysis; the current wind speed and direction of wind is continuously detected by wind measuring sensors; the ship's own data: travelling speed, direction of travel, rolling and pitching motions, is continuously detected by motion and/or navigation sensors; the detected sensor data is transmitted to a fire control calculator which controls at least one decoy launcher and generates, by taking into account all of the detected data, an effective decoy pattern that is adapted to missile and attack structure.

15 Claims, 8 Drawing Sheets

U.S. PATENT DOCUMENTS

| | | | | |
|---|---|---|---|---|
| 4,470,199 | A | 9/1984 | Krezak et al. | |
| 4,531,299 | A | 7/1985 | Wolfe et al. | |
| 4,673,250 | A | 6/1987 | Roberts et al. | |
| 4,712,181 | A * | 12/1987 | Dahlberg | 89/41.22 |
| 4,852,456 | A * | 8/1989 | Thornburg | 89/1.51 |
| 5,001,348 | A | 3/1991 | Dirscheri et al. | |
| 5,061,930 | A | 10/1991 | Nathanson et al. | |
| 5,229,540 | A | 7/1993 | Schabdach et al. | |
| 5,549,477 | A | 8/1996 | Tran et al. | |
| 5,574,458 | A | 11/1996 | Tran | |
| 5,635,662 | A * | 6/1997 | Robertson et al. | 89/1.11 |
| 5,661,254 | A | 8/1997 | Steuer et al. | |
| 5,703,314 | A | 12/1997 | Meeker | |
| 5,814,754 | A | 9/1998 | Mangolds | |
| 5,835,051 | A | 11/1998 | Bannasch et al. | |
| 6,231,002 | B1 | 5/2001 | Hibma et al. | |
| 6,414,622 | B1 | 7/2002 | Rougas | |
| 6,480,140 | B1 | 11/2002 | Rosefsky | |
| 6,497,169 | B1 | 12/2002 | Khosia | |
| 6,782,826 | B1 | 8/2004 | O'Dwyer | |
| 7,047,861 | B2 * | 5/2006 | Solomon | 89/1.11 |
| 7,086,318 | B1 * | 8/2006 | Darnall | 89/1.815 |
| 2002/0149510 | A1 * | 10/2002 | Salzeder | 342/13 |
| 2004/0046688 | A1 | 3/2004 | Bigge et al. | |
| 2007/0151493 | A1 * | 7/2007 | Graf et al. | 114/5 |
| 2007/0163430 | A1 * | 7/2007 | Kravitz | 89/1.11 |

FOREIGN PATENT DOCUMENTS

| | | | |
|---|---|---|---|
| DE | 30 19 743 | A1 | 12/1981 |
| DE | 32 29 819 | A1 | 2/1984 |
| DE | 34 21 692 | A1 | 12/1985 |
| DE | 36 12 183 | A1 | 10/1987 |
| DE | 38 35 887 | A1 | 5/1990 |
| DE | 40 14 192 | A1 | 11/1991 |
| DE | 40 14 194 | A1 | 11/1991 |
| DE | 41 15 384 | C2 | 11/1992 |
| DE | 38 82 347 | T2 | 1/1994 |
| DE | 42 29 509 | A1 | 3/1994 |
| DE | 42 38 038 | C1 | 6/1994 |
| DE | 9320382.9 | | 6/1994 |
| DE | 37 33 681 | A1 | 7/1994 |
| DE | 43 27 976 | C1 | 1/1995 |
| DE | 44 01 587 | A1 | 7/1995 |
| DE | 44 37 729 | C1 | 4/1996 |
| DE | 44 44 635 | A1 | 6/1996 |
| DE | 44 44 635 | A1 | 8/1996 |
| DE | 195 46 873 | C1 | 5/1997 |
| DE | 196 01 165 | A1 | 7/1997 |
| DE | 196 17 701 | A1 | 11/1997 |
| DE | 44 23 728 | A1 | 1/1998 |
| DE | 196 38 968 | A1 | 3/1998 |
| DE | 44 44 635 | C2 | 10/1998 |
| DE | 196 04 745 | C1 | 11/1999 |
| DE | 199 36 587 | A1 | 2/2001 |
| DE | 199 51 767 | A1 | 5/2001 |
| DE | 100 50 479 | A1 | 4/2002 |
| DE | 101 17 007 | A1 | 10/2002 |
| DE | 101 99 970 | A1 | 11/2002 |
| DE | 102 30 939 | A1 | 2/2004 |
| EP | 0 240 819 | A2 | 10/1987 |
| EP | 0 310 869 | A2 | 4/1989 |
| EP | 0 708 305 | A2 | 4/1996 |
| EP | 1 336 814 | A2 | 8/2003 |
| FR | 2 821 413 | A1 | 8/2002 |
| GB | 1 584 438 | A | 2/1981 |
| GB | 2 296 078 | A | 6/1996 |
| GB | 2 342 983 | A | 4/2000 |
| GB | 2 353 087 | A | 2/2001 |
| GB | 2 374 134 | A | 10/2002 |
| JP | 05 223 499 | A1 | 8/1993 |
| RU | 2 151 360 | C | 9/1998 |
| WO | WO 00/02000 | A1 | 1/2000 |
| WO | WO 01/36896 | A1 | 5/2001 |
| WO | WO 01/88564 | A1 | 11/2001 |

OTHER PUBLICATIONS

R.M. Ogorkiewicz and Mark Hewish: Active protection: providing a smarter shield for AFVs pp. 31-38.

Mark Hewish and Leland Ness: "Shoot First, Ask Questions Later smart tanks learn to fend for themselves" pp. 33-36.

Fritz Vollenweider: "Ahead-Luftverteidigungssystem der Zukunft" ASMZ Nr. Jan. 1994, pp. 14-15.

International Defense Review Jun. 1995: "U.S. Army to Test AFV self-defence suite pp. 12-13".

David Hughes/Merrimack, N.H.: "Army EH-60 to Flight Test Sanders Directed IR Jammer" Aviation Week and Space Technology/Mar. 28, 1994, pp. 57-60.

German Office Action issued on May 20, 2010 in corresponding German Patent Application No. 103 08 308.1.

* cited by examiner

METHOD AND APPARATUS FOR PROTECTING SHIPS AGAINST TERMINAL PHASE-GUIDED MISSILES

The present invention relates to a method for protecting ships against terminal phase-guided missiles provided with a target data analysis system, as well as a protective system apparatus.

Ever since the Israeli destroyer "EILAT" was sunk by Styx missiles of the Egyptian navy in the year 1967, antishipping missiles constitute a massive threat to ships.

Modern antishipping missiles possess radar (RF), infrared (IR), or DUAL MODE (RF/IR) sensors for the terminal phase guidance. Corresponding "intelligent" data analyses enable these missiles to discriminate between target and spurious target.

These missile-immanent data analyses meanwhile encompass any relevant temporal, spatial, spectral and kinematic features, such as, for example:

RF/IR signature analysis (dual-mode target seeking heads)
imaging methods (imaging IR)
signal frequency analysis (FFT analyses)
spatial height, depth, and side discrimination
edge tracking method
image-to-image correlation
velocity and acceleration For the protection of military objects against missiles, RF and IR decoys have for a long time been utilized in the prior art. Just like the missiles, these were optimized in the course of time and constitute an effective countermeasure.

Owing to the rather unsatisfactory imitation of the ship's signature in all the spectral ranges in which the sensory equipment of the attacking missiles operates, the current decoys and decoy methods are nevertheless not optimally suited against the threat of a ship by guided seeking weapons.

Particularly under the premise of a respective maximum possible resemblance to nautical vessels, the known decoy methods and systems are only conditionally capable of satisfying the "and"-linked demands for:

the right decoy
at the right time
in the right place.

DE 38 35 887 A1 describes a cartridge for producing phantom targets, in particular for the use with tanks for the protection against sensor-controlled ammunition. The phantom target cartridge is executed as a dual-mode ammunition, containing corner reflectors in order to imitate the radar signature of a tank, and incendiary charges in order to imitate the infrared signature of a tank. Corner reflectors and incendiary charges are distributed by an explosive charge so as to result in a tank signature in both spectral ranges.

An infrared active composition for producing phantom targets is described, e.g., in DE 43 27 976 C1. This is a flare mass on the basis of red phosphorus which preferably emits radiation in the medium wave range upon its combustion. These flares—where incorporated in corresponding decoy ammunitions—may be used for the protection, e.g., of tanks, ships, and drilling platforms.

DE 196 17 701 A1 equally describes a method for furnishing a phantom target for the protection of land, air, or water vehicles as a defense against guided target seeking missiles operating in dual mode or serially, wherein an active composition emitting radiation in the IR range and backscattering an RF radiation may be made to take simultaneous effect as a phantom target in the appropriate position.

EP 1 336 814 A2 discloses a RADAR countermeasure system for the protection of ships by deploying corner reflectors in a defined manner in azimuth and elevation in the trajectory of an approaching missile.

DE 199 43 396 moreover discloses decoys as well as a method for furnishing a phantom target, e.g. for the protection of ships, as a defense against missiles possessing both a target seeking head operating either in the infrared or radar range, as well as one operating simultaneously or serially in both wavelength ranges, wherein an IR active composition emitting radiation in the IR range on the basis of flares, and an active composition backscattering RF radiation on the basis of dipoles are made to simultaneously take effect in the appropriate position as a phantom target, with a ratio of dipole mass to flare active composition of approx. 3.4:1 to 6:1 being used; and flares being used whose descent rate is approx. 0.5 to 1.5/s higher than the descent rate of the dipoles.

HERRMANN, Helmut wt 2/89 "Tarnen und Tacuschen bei der Marine" [Concealment and Deception in the Navy] discloses a method for protecting ships against terminal phase-guided missiles provided with a target data analysis system. This reference furthermore describes that the missile moving in a direction towards the ship to be protected is detected by suitable sensors, located, and its expected trajectory is calculated by means of a computer.

For a successful defense against the missile, in accordance with HERRMANN, the direction of approach, azimuth and elevation, as well as the range must be known. Furthermore HERRMANN describes the dependency of the effective utilization of chaff on the ship's course, wind force and direction of wind, as well as the direction of the missile threat. HERRMANN also describes the use and taking into account of the ship's own data—travelling speed, direction of travel, rolling and pitching motions—for an effective deployment of decoys.

It is equally described that a computer calculates an optimal course of the ship and an optimal travelling speed of the ship in order to support the separation from the ship to be protected of the decoy formation which is deployed with support of the fire control calculator.

A similar ship protection system is disclosed in U.S. Pat. No. 4,222,306, however this does not exceed the content of disclosure of the HERRMANN article.

The means for generating special decoy patterns in dependence on decoy and attack structure are not described.

It is true that all of the mentioned documents describe the generation of decoys or phantom targets which partly have a signature resembling a ship. In combination with the available decoy ejectors, however, an effective temporal and spatial utilization of decoys for the protection of ships may not be achieved in an optimal manner by any of the hitherto disclosed methods and apparatus.

Most decoys are launched either as decoy rockets or in accordance with the mortar principle from rigid ejectors, so that an accurate positioning is not possible. Even when fired from dirigible decoy ejectors, the demanded temporal staggering and spatial separation of the decoys is extremely difficult with the hitherto disclosed methods and apparatus inasmuch as a sequential deployment with spontaneously (as a reaction to the current threat situation) selectable launching intervals and spontaneously selectable firing distances may not be realized.

Starting out from the prior art of the HERRMANN article, it is therefore the object of the present invention to furnish an improved method as well as an apparatus for the protection of ships by means of decoys.

The following demands are being made to a method and an apparatus for the protection of ships against "intelligent", terminal phase-guided missiles:

An effective decoy method or system must ensure, in dependence on missile type
missile's direction of attack
missile distance
missile velocity
ship's aspect/signature
ship's direction of travel
ship's speed
superimposed ship's own movements (rolling, pitching)
wind speed
direction of wind the possibility of generating within a minimum time period a decoy formation or pattern which is fully flexible with regard to both shape and size as well as with regard to deployment distance, deployment height, deployment direction and temporal staggering, and in particular takes into account the maritime conditions with partly considerable motion of the sea and high winds.

This decoy formation must correspond to the ship's signature in all of the spectral, spatial, and temporal criteria that are of relevance for the missile target seeking heads. The decoy formation must be composed of single decoy ammunitions so as to be able to ensure maximum flexibility and versatility with regard to shape and size of the decoy formation.

The decoys encompass decoy ammunitions which include either RF and/or IR and/or combined RF/IR active compositions so as to be able to reproduce the ship's RF and IR signatures.

The method of the invention utilizes decoy ammunitions having a generated phantom target diameter each corresponding to about 10 m to 20 m so as to be able to reproduce the spatial signature of the ship to be protected.

In accordance with the invention, the decoys are adapted to be deployed such that by means of the arrangement of individual decoy ammunitions, in particular of patterns separated in width and height, a ship-type extension and movement of the decoy formation is generated which separates from the ship to be protected.

By the method of the invention and the protective system apparatus for implementing the method it is ensured that it is possible, in dependence on all of the input parameters (missile, ship, wind), to spontaneously generate a decoy formation which is fully flexible with regard to the parameters of:

kind of the decoy ammunitions (IR, RF, IRRF),
number of the different kinds of decoy ammunitions,
time interval between the deployment of the individual decoy ammunitions,
spatial deployment coordinates of the single decoys,
kinematics of the decoy formation; as well as
shape and size of the decoy formation and thus satisfies the above described requirements.

In particular the present invention relates to a method for protecting ships against terminal phase-guided missiles provided with a target data analysis system, wherein (1) the missile moving towards the ship to be protected is detected by suitable sensors, located, and its expected trajectory is calculated by means of a computer;

(2) the type of target data analysis performed by the missile is detected by means of suitable sensors and algorithms, and the missile is classified with regard to the type of its target data analysis;

(3) the current wind speed and direction of wind is detected continuously by means of wind measuring sensors;

(4) the ship's own data: travelling speed, direction of travel, rolling and pitching motions, is continuously detected by means of motion and/or navigation sensors;

(5) the detected data from (1) to (4) is transmitted to a fire control calculator by means of data interfaces;

(6) at least one decoy launcher is controlled by means of the fire control calculator, and the firing of decoy ammunitions is initiated, with the fire control calculator controlling the deployment of the decoys based on the evaluated sensor data with regard to:
- kind of the ammunition type;
- number of the different ammunition types;
- temporal firing interval between successive ammunitions;
- the firing direction of each ammunition in azimuth and elevation, including the compensation of rolling and pitching motions of the ship;
- the delay time of the ammunitions from firing until activation of the effective charge, and thus the distance of the decoy effect;

and (7) the fire control calculator calculates an optimal course of the ship and an optimal speed of the ship so as to support the separation of the decoy formation deployed from the ship to be protected in a control computer-supported manner; wherein (8) the ship's on-board wind measuring equipment is used as the wind measuring sensors; and wherein (9) the ship's own data is detected by the navigation equipment and the gyroscopic stabilization equipment of the ship to be protected or by means of separate acceleration sensors, in particular pitch, roll, or gyroscopic sensors, wherein

(10) a particular decoy pattern is generated in dependence on the identified missile and the attack structure, with the appropriate decoy pattern for the respective type of threat, characterized in that missile type and homing behavior are stored in a database and fetched by the fire control calculator following identification of the missile type and attack structure, in order to build up a corresponding decoy pattern.

It is preferred if RF and/or IR and/or UV sensors are used for detection of the approaching missile. Preferably the ship's on-board reconnaissance radars are used.

Preferably the wind measuring sensors of the ship's on-board wind measuring equipment are used for detecting direction of wind and wind speed.

Furthermore the ship's own data, in particular pitching and rolling motions, is detected by the navigation equipment and the gyroscopic stabilization equipment on board of the ship to be protected or by means of separate acceleration sensors.

As data interfaces, for example standardized interfaces, in particular NTDS, RS232, RS422, ETHERNET, IR, or BLUETOOTH interfaces are used.

As decoy ammunitions, those with RF, IR, and combined RF/IR active compositions as well as radar reflectors known per se (Airborne Radar Reflectors) are used.

As a fire control calculator, preferably a personal computer, a micro-controller control or an SPS control is used, with the fire control calculator transmitting the determined data for deploying the decoy formation to the decoy launchers via a standardized data interface, in particular via a CAN bus (Controller Area Network Bus).

Here it is a preferred embodiment of the present invention if a radio frequency reflector, in particular a radar reflector, preferably a corner reflector, preferably a radar reflector having eight tri-hedral corner reflectors (tri-hedrals), in a particularly preferred manner a corner reflector known per se; preferably in the form of nettings or foils, is used as a decoy.

The protective system apparatus in accordance with the invention, which is suited for implementing the method in accordance with the present invention, is equipped with:

at least one computer;

sensors for detecting terminal phase-guided missiles having a target data analysis system for discriminating between a genuine and a spurious target, that approach a ship to be protected;

sensors for detecting the direction of approach, distance, and velocity of the missiles;

wind measuring means for wind speed and direction of wind;

motion and/or navigation sensors for detecting the ship's own data: travelling speed, direction of travel, rolling and pitching motions;

at least one fire control calculator, wherein in particular fire control calculator and computer form a unit; and wherein the fire control calculator communicates with the sensors via data interfaces;

at least one decoy launcher arranged on the ship and dirigible in azimuth and elevation, which is equipped with decoy ammunitions, wherein the ammunition types comprise RF, IR, and combined RF/IR ammunitions as well as unfolding corner reflectors; wherein the computer includes a database in which appropriate decoy patterns for the respective missile type and the respective attack structure are stored, which allow to generate, in dependence on the identified missile and the attack structure, a particular decoy pattern so as to effectively protect a ship against the identified threat.

A suitable decoy launcher may, e.g., include the following components:

a launching platform as a carrier of the single decoy ammunitions;

electric launching means which fire the single decoy ammunitions in randomly adjustable temporal intervals, an elevational drive for movement in height of the launching platform, an azimuthal drive for sideways movement of the launching platform, a base platform for receiving the drives, shock absorbers at the base platform for attenuating rapid ship movements particularly brought about by mine detonation shocks;

STEALTH trimmings for reducing the ship's signature in the RF and IR ranges, preferably formed of obliquely inclined metallic or carbon fiber surfaces; as well as a suitable interface which transmits the delay time of the decoy ammunition(s) from launch to activation of the effective charge immediately prior to launch from the decoy launcher to the decoy ammunition(s), preferably having the form of an electric plug-in connection or of an inductive connection via two corresponding coils.

Further advantages and features will become evident from the description of an exemplary embodiment and from the drawing, wherein:

FIG. 1 is a schematic view of an exemplary protective system apparatus;

FIG. 2*a* is a schematic top view of an exemplary decoy formation deployed in accordance with the invention, as a countermeasure against an attacking RF-guided missile;

FIG. 2*b* is a schematic lateral view of an exemplary decoy formation deployed in accordance with the invention as a countermeasure against an IR-guided missile;

A missile attacking the ship to be protected is detected, located and identified by means of suitable sensors (FIG. 1A), with these sensors preferably including RF, IR, and/or UV sensors (e.g., EloUM equipment as well as FL1800, MSP, MILDS, or the like).

By means of suitable sensory equipment the current wind speed and direction of wind is detected continuously (FIG. 1A), with this sensory equipment in the exemplary case being realized through the ship's on-board wind measuring equipment.

The ship's own data is equally detected by means of suitable sensory equipment. In the exemplary case, travelling speed, direction of travel, rolling motions and pitching motions of the ship to be protected are detected (FIG. 1A), with this sensory equipment in the exemplary embodiment being adapted from the ship's on-board navigation equipment and gyroscopic stabilization equipment. Measurement of these parameters may, of course, also be realized by separate devices for determining the rolling and pitching motions of the ship.

The determined sensor data is transmitted by means of suitable data interfaces to a fire control calculator (FIG. 1B), with these data interfaces in the present exemplary embodiment being executed as RS232 interfaces.

Other possible standardized interfaces include, e.g., NTDS, RS 422, ETHERNET, IR, or BLUETOOTH interfaces.

In the case of a detected approaching missile, a decoy launcher in FIG. 1C is controlled with the aid of a suitable fire control calculator, in the exemplary case a PC.

Figure 1:
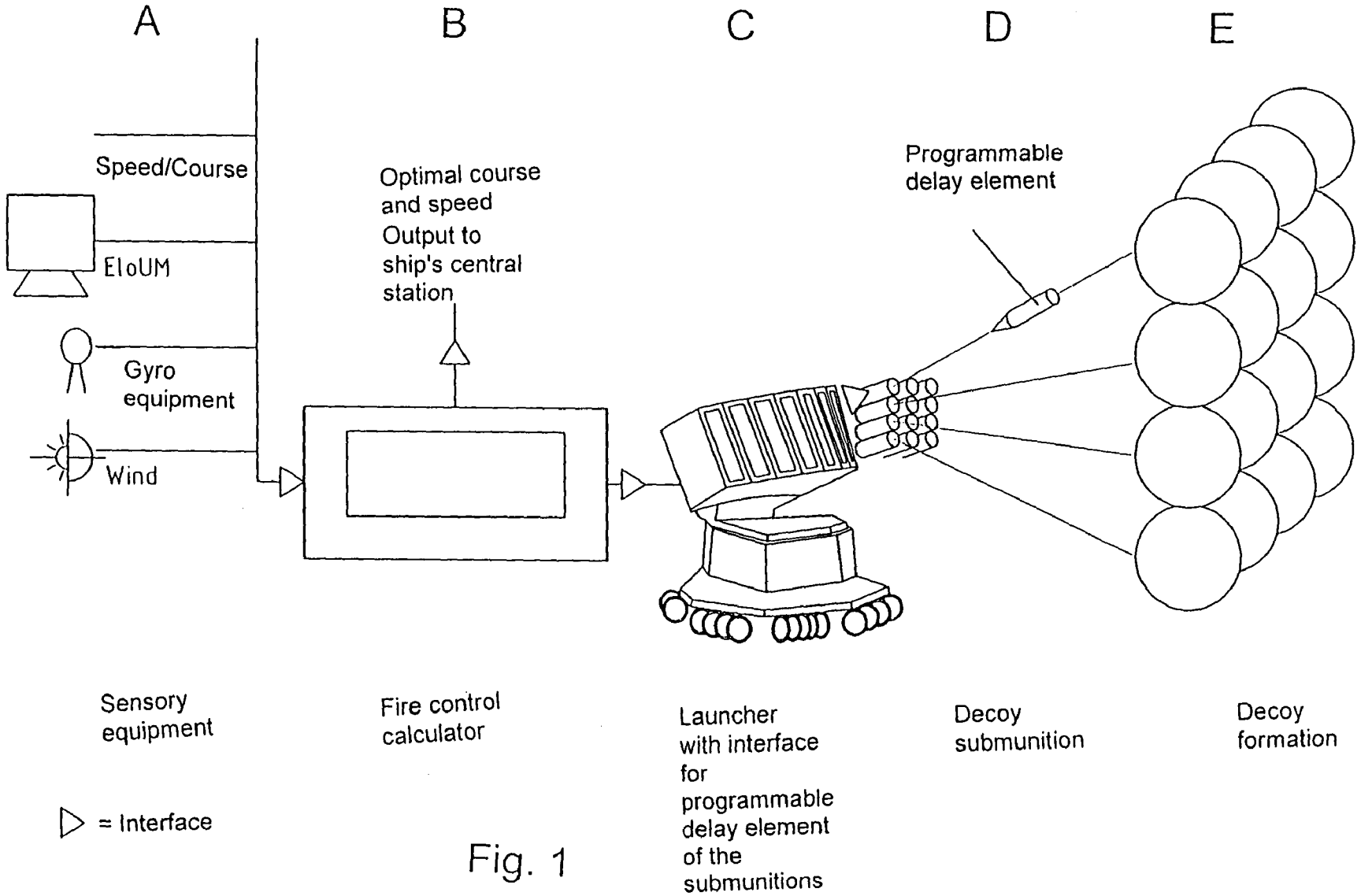
FIG. 1 shows in a schematic view a protective system apparatus in accordance with the invention.

Control of the decoy launcher and firing the decoy ammunitions, which are represented in FIG. 1 in section D, is in the exemplary case performed in regard of:

the kind of the different decoy ammunitions (RF, IR, combined RF/IR), the number of the different decoy ammunitions types (RF, IR, RF/IR), the temporal firing interval between successive decoy ammunitions, the firing direction in azimuth (including the compensation of rolling and pitching motions of the ship) of each decoy ammunition, the firing direction in elevation (including the compensation of rolling and pitching motions of the ship) of each decoy ammunition, the delay time of the decoy ammunition(s) from launch to activation of the effective charge; as well as the calculation of the ship's optimal course and ship's speed for supporting the separation kinematics of the decoy formation, with this fire control calculator in the exemplary case being realized by a personal computer.

As an alternative it is also possible to employ a microcontroller control or an SPS control as a fire control calculator.

In the exemplary case, the calculated data of the fire control calculator with regard to optimal course of the ship and ship's speed is transmitted by means of an RS 232 data interface to the ship's central station (FIG. 1B). As an alternative it is also possible to use other standardized interfaces, e.g., NTDS, RS 422, ETHERNET, IR and BLUETOOTH interfaces.

Transmission of the data of the fire control calculator to one or several decoy launchers (FIG. 1B) in the present exemplary embodiment takes place via CAN bus interfaces.

The exemplarily utilized decoy launcher is pivotable at least in two axes (azimuth and elevation) (FIG. 1C). In order to deploy a decoy formation, which is represented in section E of FIG. 1, the decoy ammunitions are in fired in a manner directed in elevation and azimuth.

The decoy ejector used in the exemplary case includes the following components:

- a launching platform as a carrier of the single decoy ammunitions,
- electric launching means 7 which fire the single decoy ammunitions 6 in randomly adjustable temporal intervals,
- an elevational drive 8 having the form of an electric hydraulic or pneumatic drive for movement in height of the launching platform, as well as an azimuthal drive 9 having the form of an electric, hydraulic or pneumatic drive for sideways movement of the launching platform,
- a base platform for receiving the drives,
- a shock absorber 10 at the base platform for attenuating rapid ship movements owing, e.g., to mine detonation shocks,
- STEALTH trimmings 11 for reducing the ship's signature in the RF and IR ranges, preferably formed of obliquely inclined metallic or carbon fiber surfaces,
- a suitable interface for transmitting the delay time (of the decoy ammunition(s) from launch to activation of the effective charge) immediately prior to launch from the decoy launcher to the decoy ammunition(s), exemplarily having the form of an electric plug-in connection or of an inductive connection via two corresponding coils.

The decoy ammunitions comprise integrated, electronically freely programmable delay elements in which the delay times transmitted from the launcher or fire control calculator, respectively, are stored, so that the activation of the active compositions is initiated following lapse of the delay time (FIG. 1D), wherein these delay elements are executed in the exemplary embodiment as a microcontroller circuit, wherein the decoy ammunitions have a separate energy storage whereby the energy supply of the programmable delay element as well as the energy supply of the active composition initiation and distribution in the decoy ammunitions is achieved (FIG. 1D), wherein it is possible to realize this energy storage in the exemplary case through chargeable capacitors, through chargeable accumulators, or through batteries.

Lastly, by means of the decoy ammunitions variable in distance, in connection with the dirigible decoy launcher, a decoy pattern is generated that is freely selectable in all spatial and temporal dimensions (FIG. 1E), wherein the active compositions contained in the decoy ammunitions include effective charges having an RF, IR, or combined RF/IR effect which reproduce the signature of the ship to be protected. The decoy 6 may be unfolded by inflating with hot gases from gas generators 17, for example, pyrotechnical gas generators, or air bag gas generators.

Figure 2A:
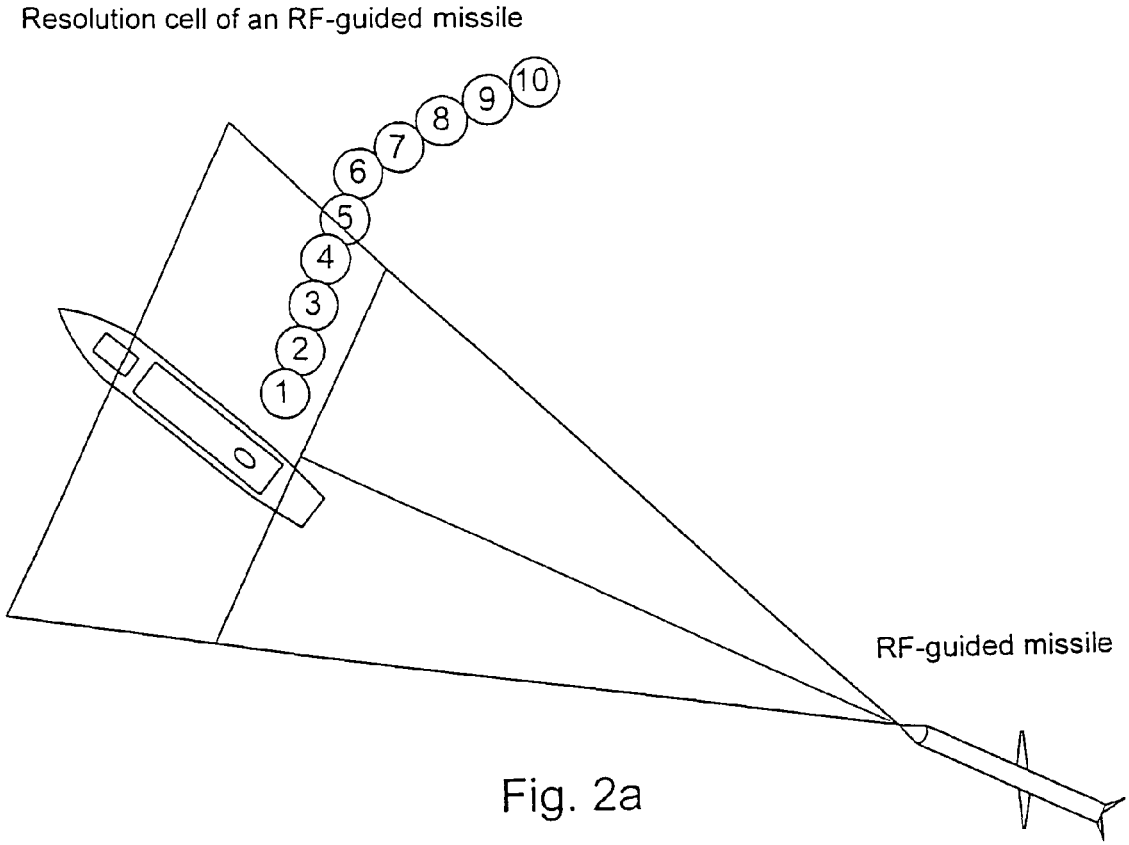
Figure 2B:
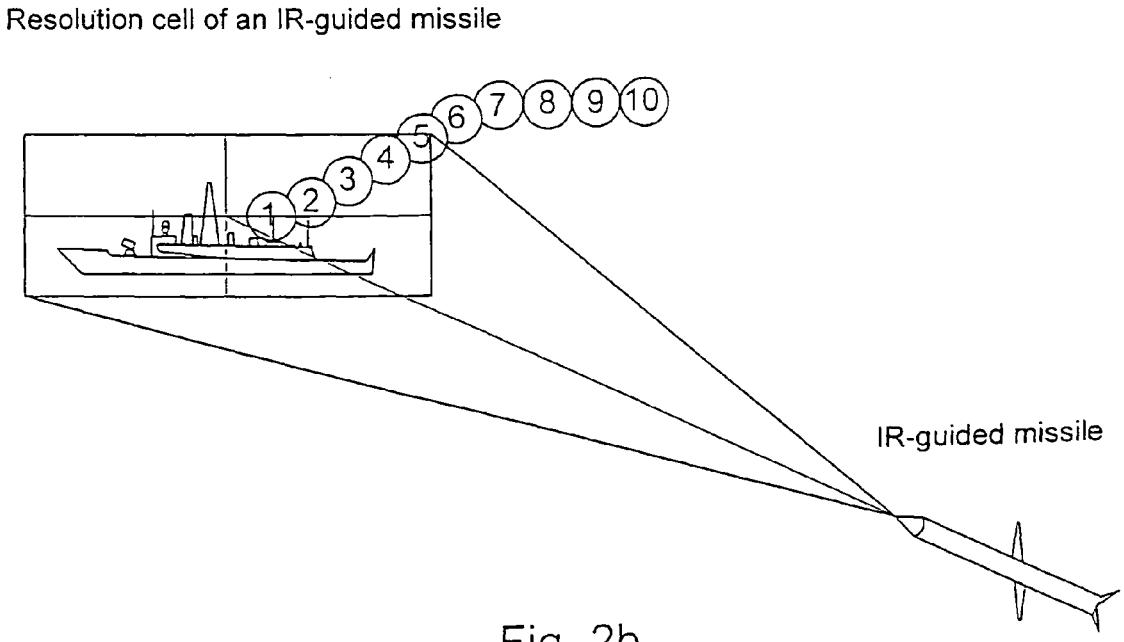

FIGS. 2*a* and 2*b* exemplarily show a top view and a lateral view, respectively, of a possible decoy formation in the case of an approaching RF-guided missile (FIG. 2*a*) and of an IR-guided missile approaching the ship to be protected.

In these figures it is visible that a multiplicity of different decoy ammunitions (in the exemplary case 10 pcs.) may flexibly be staggered temporally, in terms of distance, as well as height and direction, by means of the method in accordance with the invention.

By the method in accordance with the invention it is possible, e.g., to generate a decoy formation which begins in the immediate vicinity of the ship (FIG. 2*a*: decoy 1), is subsequently built up sequentially at a right angle to the missile's direction of attack (2*a*: decoy 2-decoy 6), and is then taken away while changing directions (2*a*: decoy 7-decoy 10).

By means of a concurrent separation in height (FIG. 2*b*: decoy 1-decoy 10), which determines in conjunction with the descent rate of the activated decoy effective charges the duration of effect of the single ammunitions, it is moreover possible to produce a kinematic of the decoy formation resembling a ship. In this way, the necessary separation of decoy formation and ship is guaranteed, in order to make sure that decoy formation and ship to be protected are separated far enough from each other so that the approaching missile will move into the phantom target without constituting a danger to the ship.

Missiles intended to fight naval targets are provided for target detection and target tracking with sensors operating in the following electromagnetic wavelength ranges: ultra-violet (UV), visual/electro-optical range (EO), LASER (e.g., 1.06 μm and 10.6 μm), infrared (IR), as well as RADAR (e.g., I/J band and mmW).

With the aid of electronic methods (such as filtering methods) and mathematical algorithms (such as pattern recognition), these modern missiles are capable of discriminating between genuine naval targets (such as ships, drilling rigs, . . . ) and spurious targets by using spectral, temporal, kinematic, and spatial differentiation features.

Figure 3:
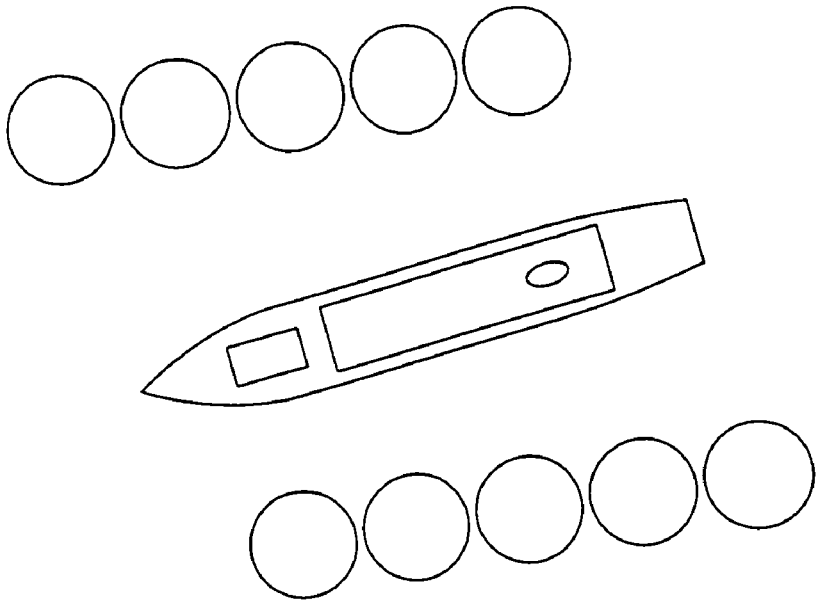
FIGS. 3-7 show different decoy patterns.

In order to be able to defend against the multiplicity of various missiles in different threat situations by means of a decoy system, the ability of generating individually adapted, accurately placed decoy patterns in response to any threat situation is indispensable. The specific threat situation is here defined as given by the following parameters:

- missile type (i. a., sensor type, target tracking algorithm, etc.)
- direction of approach of the missile
- approach velocity of the missile
- distance of the missile
- travelling speed of the ship
- ship's type (geometry)
- ship's signature (radar, infrared)
- ship's course
- direction of wind
- wind speed FIGS. 3 to 7 exemplarily show some temporally and spatially staggered decoy patterns required for defending against a missile, which are composed of single decoys (represented as circles/spheres), which are stored in a database of the computer, and which are adapted to the respective missile type and the associated attack structure. FIG. 3 shows a decoy pattern capable of affording a sandwich-type protection against approaching missiles for the flanks of a ship on both sides. The decoy pattern is shown in a top view.

Figure 4:
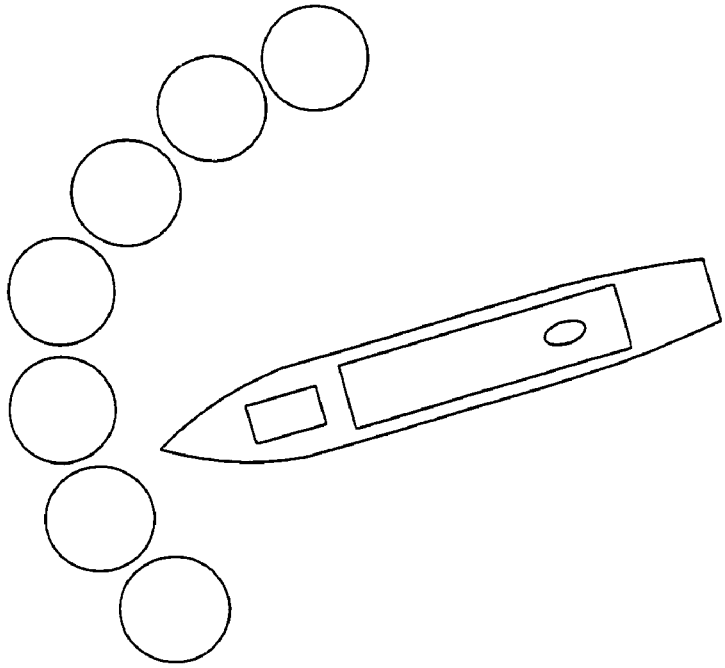

FIG. 4 shows a top view of an umbrella-type decoy pattern which is suited, e.g., as a defense against frontal attacks and attacks obliquely from the front.

Figure 5:
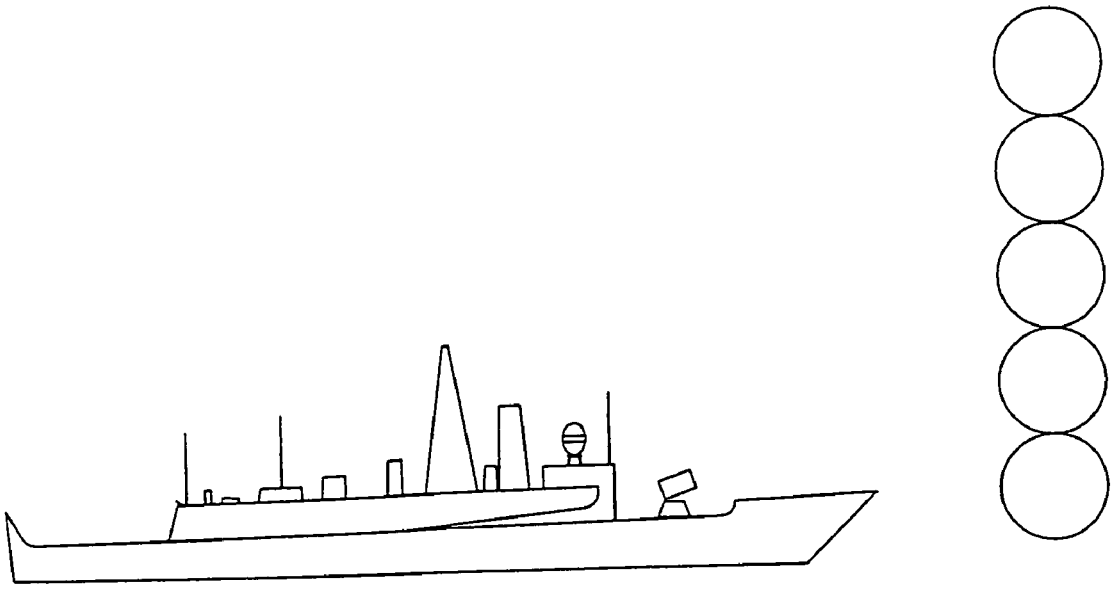

FIG. 5 shows a lateral view of a tower-shaped decoy pattern as a defense against frontally approaching guided seeking missiles.

Figure 6:
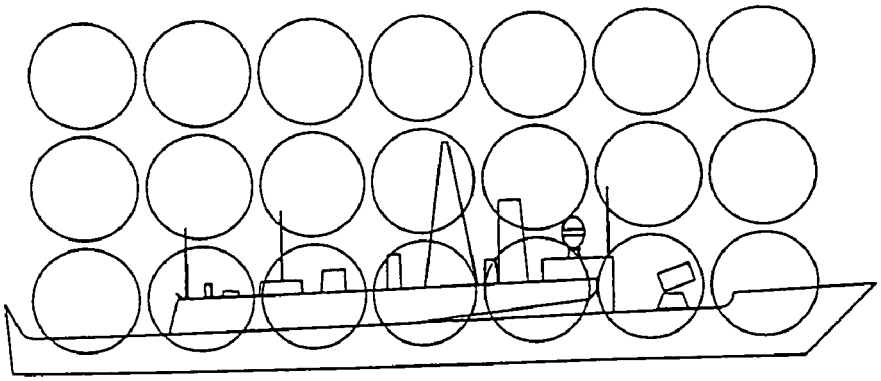

FIG. 6 shows in a schematic representation a lateral view of a camouflage screen which equally serves for protection of the flanks.

Figure 7:
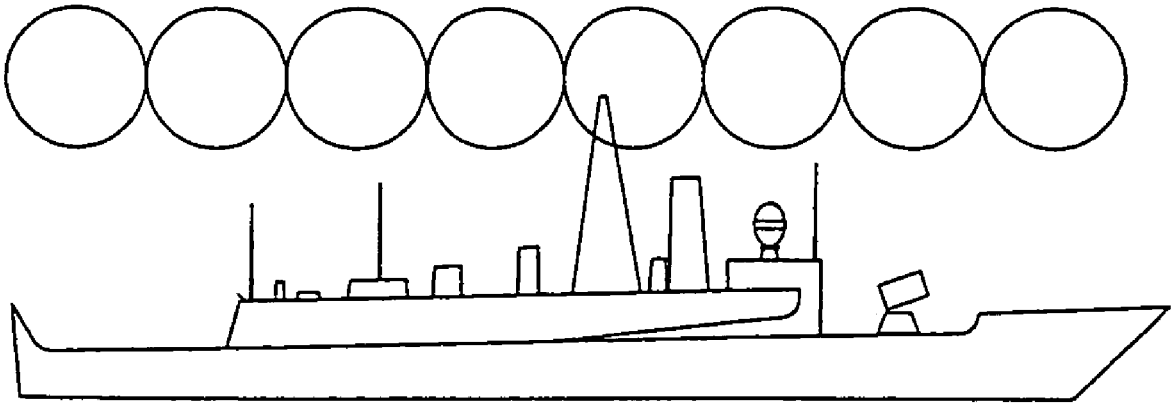

FIG. 7 shows in a lateral view a decoy pattern which serves as a defense against attacks from above, i.e., so-called top attacks.

In accordance with the invention a decoy system is described which calculates by means of a tactical mission calculator the optimal decoy pattern for the specific threat situation for a defense against a missile with regard to the required number of decoy(s) and the spatial and temporal intended coordinates ($x_n$, $y_n$, $z_n$, $t_n$), and subsequently realizes the accurate spatial ($x_n$, $y_n$, $z_n$) and temporal ($t_n$) positioning of the decoys by means of a decoy ejector. In other words, the gist of the invention resides in the fact that virtually any patterns may be formed of decoy clouds even under the conditions of a rough sea.

Figure 8:
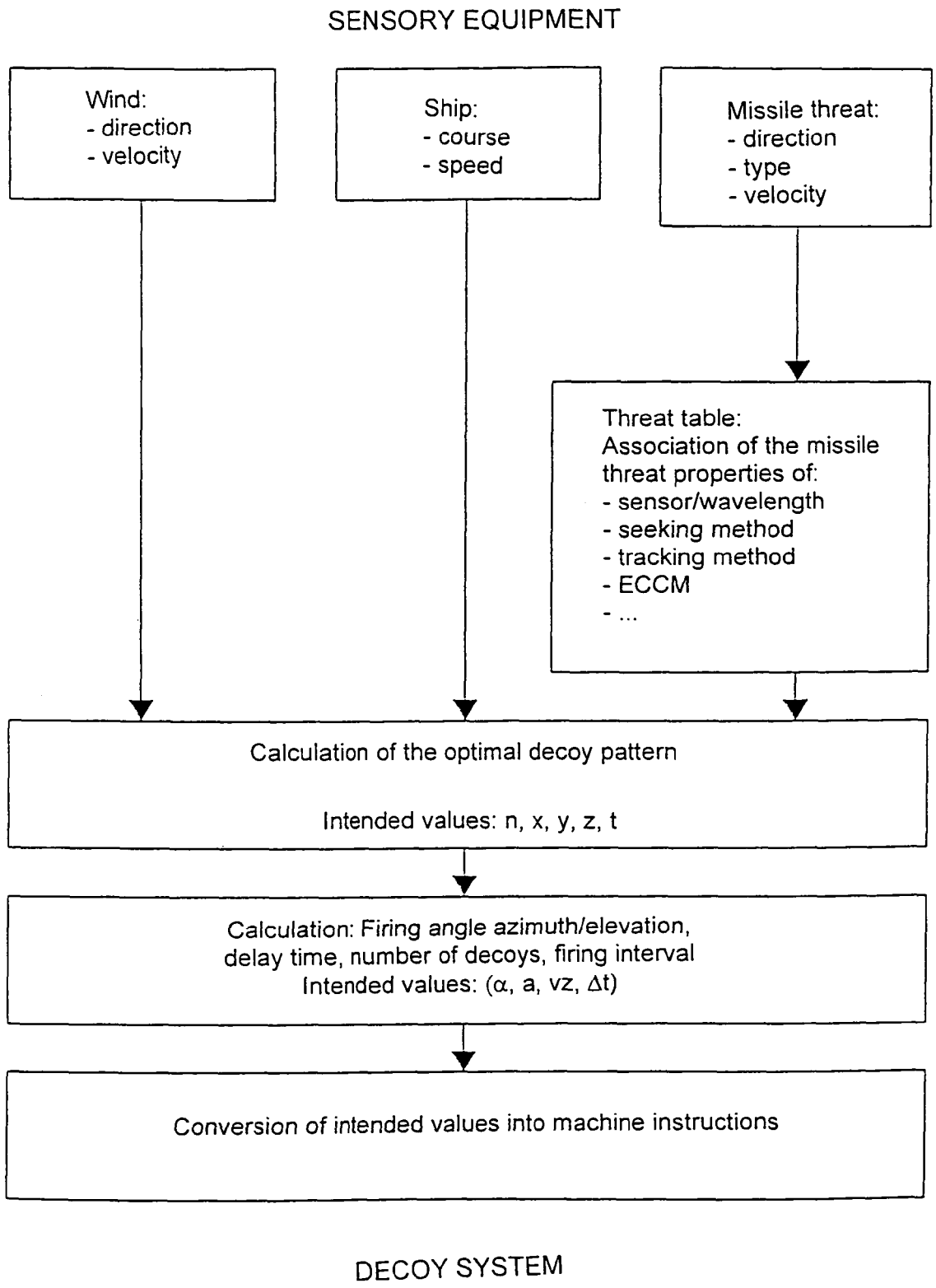
FIG. 8 shows a schematic flow diagram of the decoy system in accordance with the invention.
Figure 9:
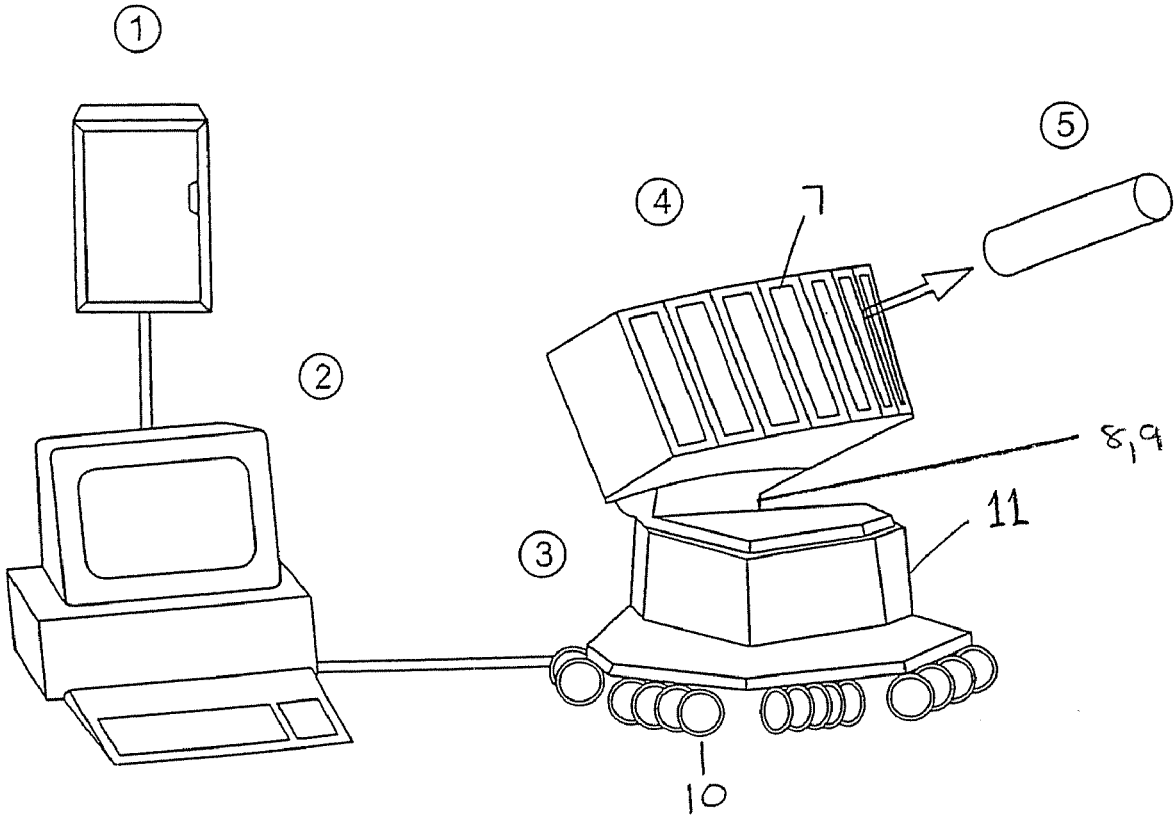
FIG. 9 shows the essential elements of the device in accordance with the invention.
Figure 10:
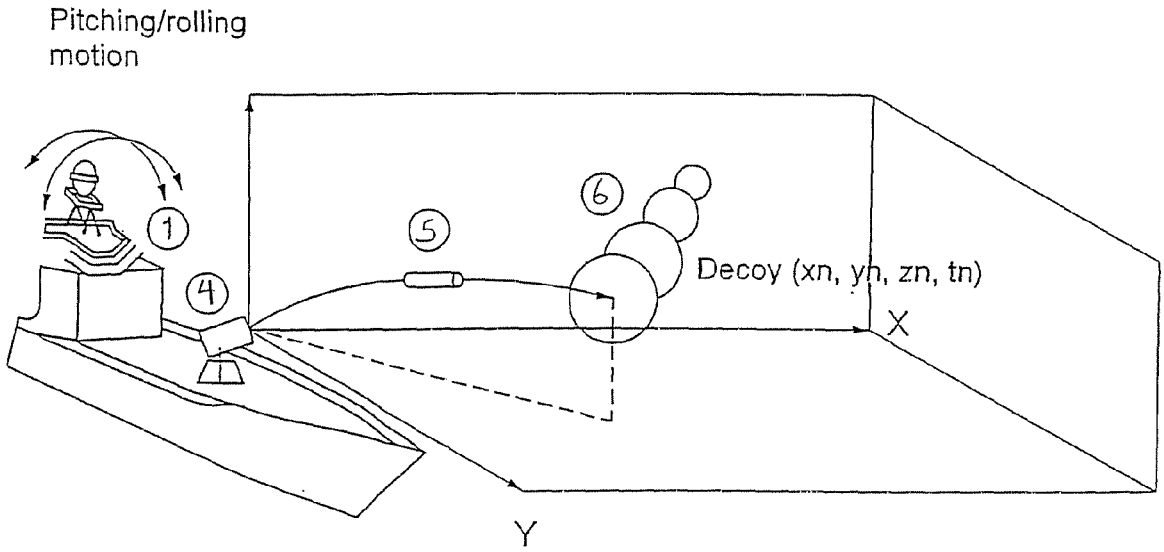
FIG. 10 is a schematic representation of the formation of a decoy pattern at the intended coordinates.
Figure 11:
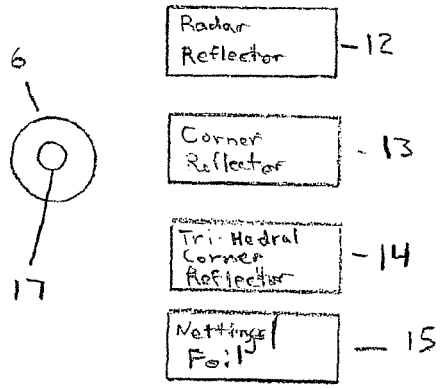
FIG. 11 is a schematic representation of various types of decoys.

In the flow diagram of FIG. 8 and in FIGS. 9 and 10 the functional chain, or the schematic construction of the equipment, respectively, is represented:

By means of suitable sensory equipment the wind data (wind speed and direction of wind) as well as the ship's own data (velocity, course, pitching and rolling motions)) is detected and supplied to a central computer (FIG. 9, reference symbol 2).

Warning sensors detect approaching missiles, and the respective missile type as well as its direction of approach and distance are determined. This data is also supplied to the central computer 2. The specific data relevant for a missile defense with regard to the detected missile type is fetched from a correlation database (threat table). This is in particular:

- the missile's sensory equipment (radar, EO, infrared, LASER)
- missile velocity
- the missile's searching and tracking method
- missile filtering methods
- electronic countermeasures (ECCM) of the missile Depending on this missile data and the ship's data (velocity, course, radar signature, infrared signature) and wind parameters (velocity and direction), the optimal decoy pattern in regard of the number of decoy(s) required for defense against the missile as well as their spatial and temporal intended coordinates ($x_n$, $y_n$, $z_n$, $t_n$) is now determined individually (for examples, see FIGS. 1 . . . 5).

For the case that no data concerning the missile is available in the correlation database, recourse is made to a generic decoy pattern which is also stored in a database for particular threat situations and missiles (for instance a "camouflage screen" in accordance with FIG. 6).

In order to realize the predetermined decoy pattern (intended values), an apparatus is used in accordance with the invention which possesses the following components (see FIG. 9):

a) sensory equipment for detecting the rolling and pitching motions of the ship relative to an artificial horizon
b) computer(s) for calculation of the firing data
c) a 2-axis directing unit movable in azimuth and elevation
d) a launching platform having a multiplicity of individually controllable launching elements
e) decoy ammunitions equipped with programmable delay elements, which are programmed from the launching platform via a data interface such that the effect begins to unfold once the intended coordinates ($x_n$, $y_n$, $z_n$) are reached.

For the purposes of the further description, reference is made for simplicity to the decoy pattern represented in FIG. 10 (FIG. 10, reference symbol 6), which is composed of merely n=4 decoys. The spatial ($x_n$, $y_n$, $z_n$) and temporal intended coordinates ($t_n$) are unambiguously defined with regard to the decoy ejectors (FIG. 10, reference symbol 4) installed on the ship (TK ($x_n$, $y_n$, $z_n$, $t_n$)).

In order to realize the predetermined decoy pattern (intended values), in accordance with the invention the following calculation steps are performed by means of the computer implementing physical-mathematical standard procedures:

Calculation of the ballistic trajectories of the decoy ammunitions in dependence on the air resistance, mass (m), and velocity of departure ($V_o$)thereof.

Calculation of the necessary angle of departures of the decoy ammunitions in azimuth ($\#\#\#_n$) and elevation ($\#\#\#_n$), whereby it is made sure that the previously calculated ballistic trajectories intersect the intended coordinates ($x_n$, $y_n$, $z_n$).

Calculation of the required flight times of the decoy ammunitions up to reaching the intended coordinates ($x_n$, $y_n$, $z_n$).

Calculation of the necessary temporal staggering (###t) in firing the single decoy ammunitions so as to ensure the correct temporal positioning ($t_n$) at the intended coordinates ($x_n$, $y_n$, $Z_n$).

Calculation of the necessary compensatory angle in azimuth (######) and elevation (######) for compensation of the angle of departure errors brought about by pitching and rolling motions of the ship.

Calculation of the necessary Compensatory angle in azimuth (######) and elevation (######) for compensation of the temporal shifts of the intended coordinates ($x_n$, $y_n$, $z_n$, $t_n$) brought about by travel and course of the ship.

The values thus calculated are now converted into machine instructions, and the equipment described in FIGS. 9 and 10 is controlled thereby. In this way an accurate decoy placement and pattern that is adapted to the threat situation is realized.

In the following, a specific exemplary embodiment of the invention shall be described.

Sensor for detecting the rolling and pitching motions (FIG. 9, reference symbol 1)

The ship's own movements, rolling and pitching, are detected by gyroscopic stabilization equipment, preferably by an inclinometer.

Computer for the calculation of the firing data (FIG. 9, reference symbol 2)

Basically all the customary computers 2 are suited, however preferably a microprocessor-based PC or SPS controls are employed.

The computer calculates from the intended coordinates ($x_n$, $y_n$, $z_n$, $t_n$) of the decoys the temporal staggering (###t) and through the given ballistics (at an identical velocity of departure $v_0$) by means of a mathematical approximation method, e.g., 'Runge-Kutta method', the firing azimuth $\#\#\#_n$, the firing elevation $\#\#\#_n$, and the required flight time and thus the effective distance $d_n$ of the single decoy ammunitions.

The calculated data is converted by control equipment, preferably servo-controllers, into machine instructions for the above described, 2-axis launcher (FIG. 9, reference symbol 3) movable in azimuth and elevation, and transmitted.

The launcher movable in two axes is realized by means of electric, hydraulic, or pneumatic directional drives. Preferably an electric drive is used which either acts directly on the launching platform, or preferably indirectly transmits the movement to the launching platform through the intermediary of a transmission. The power of the drives for the azimuthal directing movement and the elevational directing movement is adapted to the masses to be moved and torques. In order to be able to reach an adequate reaction speed, and in order to be able to compensate the ship's own movements, the drives are designed such that an angular velocity of more than 50 DEG/s, or an angular acceleration of more than 50 DEG/$s^2$ (positive and negative acceleration) is achieved both for the azimuthal directing movement and for the elevational directing movement.

The directing range is designed such that when taking into account the details of the launching platform, a firing direction in azimuth of 0 DEG to 360 DEG and in elevation a firing direction of 0 DEG to 90 DEG is achieved. Programmable firing restrictions were realized, so that firing the decoy ammunition in the direction of the ship's superstructures should be avoided. For safety reasons preferably program memories on an EPROM basis are employed.

A launching platform having a multiplicity of individually controllable launching elements (FIG. 9, reference symbol 4)

The launching platform is designed such that firing of at least 20 single decoys is possible. Preferably any decoy ammunition may be fired singly. In addition it is realized that programming of the flight time of the decoy ammunitions to the desired effective distance is performed through the intermediary of the launching platform. The interface with the decoy ammunition may be realized through contacts, however is preferably realized through an inductive interface so as to avoid corrosive influences on data transmission.

Decoy ammunitions with programmable delay elements which may be programmed from the launching platform through the intermediary of a data interface (FIG. 9, reference symbol 5)

The decoy ammunitions are designed such that all have the same velocity of departure ($v_0$). This is necessary in order to ensure the correct and accurate placement of the decoys on the basis of the computer's ballistic calculations. The maximum flight distance preferably is at least 100 m. The $v_o$ is adapted in correspondence with the ammunition's weight, the drag coefficient ($c_w$), and the front end surface area (A).

The decoy ammunitions each comprise a programmable delay element, so that the flight times until taking effect at the intended coordinates ($x_n$, $y_n$, $z_n$) are variable and may be programmed immediately prior to launching by means of the launching platform. The interfaces with the launching platform are preferably made to be inductive, i.e. through a respective coil system.

In a preferred embodiment of the present invention, a radio frequency reflector, in particular a radar reflector 12, a corner reflector 13, a radar reflector having eight tri-hedral corner reflectors (tri-hedrals) 14, a corner reflector known per se in the form of nettings or foils 15, may be used as a decoy 6.

The invention claimed is:

1. A protective system apparatus for the protection of ships against terminal phase-guided missiles comprising a target data analysis system, comprising:

at least one computer;

sensors for detecting terminal homing phase-guided missiles having a target data analysis system for discriminating between genuine and spurious target, that approach a ship to be protected;

sensors for detecting the direction of approach, distance, and velocity of the missiles;

wind measuring sensors for wind speed and direction of wind;

motion and/or navigation sensors for detecting the ship's own data including at least one of travelling speed, direction of travel, rolling and pitching motions;

at least one fire control calculator, wherein the fire control calculator and the computer form a unit; and wherein the fire control calculator communicates with the sensors via data interfaces;

at least one decoy launcher arranged on the ship and in a dirigible each being equipped with decoy ammunitions, wherein the computer includes a database in which appropriate decoy patterns for respective missile types and respective attack structures are stored, which generate, in dependence on the identified missile and the attack structure, a particular decoy pattern so as to effectively protect a ship against the identified threat, and wherein the at least one decoy launcher includes the following components:

a launching platform as a carrier of single decoy ammunitions;

electric launcher which fires the single decoy ammunitions in randomly adjustable temporal intervals, an elevational drive for movement in height of the launching platform, an azimuthal drive for sideways movement of the launching platform, a base platform for receiving the drives, shock absorbers at the base platform for attenuating rapid ship movements particularly brought about by mine detonation shocks;

STEALTH trimmings for reducing the ship's signature in the RF and IR ranges;

an interface which transmits a delay time of the decoy ammunition(s) from launch to activation of an effective charge immediately prior to launch from the at least one decoy launcher to the decoy ammunition(s), having the form of an electric plug-in connection or of an inductive connection via two corresponding coils.

2. Apparatus in accordance with claim 1, wherein the decoy ammunitions comprise integrated, electronic delay elements freely programmable by the fire control calculator.

3. Apparatus in accordance with claim 1, wherein the at least one decoy launcher is provided with at least one electric, hydraulic, and pneumatic directional drives, with the angular acceleration in the azimuthal direction and in the elevational direction being at least 50 DEG/$s^2$.

4. Apparatus in accordance with claim 1, wherein RF and/or IR and/or UV sensors are provided for detection.

5. Apparatus according to claim 4, wherein the RF and/or IR and/or UV sensors are a ship's on-board reconnaissance sensors.

6. Apparatus in accordance with claim 1, wherein standardized interfaces, in particular at least one of NTDS, RS232, RS422, ETHERNET, IR, and BLUETOOTH interfaces are provided as data interfaces.

7. Apparatus in accordance with claim 1, wherein the decoy ammunitions include at least one of RF, IR, and combined RF/IR active compositions as well as unfolding, floating radio frequency reflectors, in particular radar reflectors (Airborne Radar Reflectors).

8. Apparatus in accordance with claim 7, wherein unfolding decoys are provided, wherein the folded decoys are fired by the at least one decoy launcher and are adapted to be unfolded by gases during the launch.

9. Apparatus in accordance with claim 8, wherein at least one of a radio frequency reflector, a radar reflector, a corner reflector, a radar reflector having eight tri-hedral corner reflectors (tri-hedrals), and nettings or foils, is provided as a decoy.

10. Apparatus in accordance with claim 8, wherein the decoy may be unfolded by inflating with hot gases.

11. Apparatus in accordance with claim 1, wherein the decoy may be inflated by pyrotechnical gas generators, in particular airbag gas generators.

12. Apparatus in accordance with claim 1, wherein that a decoy ammunition with programmable delay elements is provided.

13. Apparatus in accordance with claim 1, wherein all of the decoy ammunitions used for a particular decoy pattern have an identical velocity of departure ($v_0$).

14. Apparatus in accordance with claim 1, wherein the fire control calculator is at least one of a personal computer, a micro-controller control and an SPS control, with the fire control calculator including a standardized data interface, in particular a CAN bus (Controller Area Network bus) to transmit the determined data for deploying the decoy formation to the decoy launchers.

15. Apparatus according to claim 1, wherein the STEALTH trimmings are formed of at least one of obliquely inclined metallic surfaces and carbon fiber surfaces.

* * * * *